US005342048A

United States Patent [19]

Jones et al.

[11] Patent Number: 5,342,048

[45] Date of Patent: Aug. 30, 1994

[54] WALL MOUNTED SLOT CAR TRACK WITH MOVING ACCESSORIES

[75] Inventors: Lawrence T. Jones, Westlake Village; Richard L. May, Manhattan Beach, both of Calif.

[73] Assignee: California R & D Center, Westlake Village, Calif.

[21] Appl. No.: 14,322

[22] Filed: Feb. 5, 1993

[51] Int. Cl.[5] ..... A63F 9/14

[52] U.S. Cl. ..... 273/86 B; 446/444; 446/445

[58] Field of Search ..... 273/86 R, 86 B, 86 C, 273/DIG. 26; 446/227, 444, 445, 446, 447, 129, 136; 104/53, 60, 63

[56] References Cited

U.S. PATENT DOCUMENTS

| | | | |
|---|---|---|---|
| 2,631,853 | 5/1953 | Haynes et al. | 273/86 |
| 2,703,534 | 3/1955 | Copeland | 446/446 X |
| 3,367,657 | 2/1968 | Cobbenhagen et al. | 273/86 |
| 3,410,223 | 11/1968 | Miller | 104/60 |
| 3,411,783 | 11/1968 | Montagna | 273/86 |
| 3,667,672 | 6/1972 | Kennedy et al. | 273/86 R X |
| 4,066,211 | 1/1978 | Mak . | |
| 4,163,555 | 8/1979 | Norwalt et al. | 273/86 B |
| 4,386,777 | 6/1983 | Prehodka | 273/86 B |
| 4,697,812 | 10/1987 | Rudell et al. | 273/86 B |
| 4,728,104 | 3/1988 | Cheng | 273/86 B |
| 4,795,154 | 1/1989 | Lahr | 273/86 B |
| 4,940,444 | 7/1990 | Russell | 273/86 B |
| 4,990,117 | 2/1991 | Yonezawa | 446/444 X |
| 4,997,187 | 5/1991 | Smoller et al. | 273/86 B |

FOREIGN PATENT DOCUMENTS

| | | | |
|---|---|---|---|
| 1137663 | 5/1962 | Fed. Rep. of Germany . | |
| 512304 | 9/1955 | Italy . | |
| 2070947 | 7/1981 | United Kingdom | 273/86 B |

*Primary Examiner*—Vincent Millin
*Assistant Examiner*—William M. Pierce
*Attorney, Agent, or Firm*—Price, Gess & Ubell

[57] ABSTRACT

A combination decorative kinetic poster and vertical vehicle toy racing game includes a substrate having colorful indicia for providing a decorative design. The substrate is designed to be vertically hung on a wall and is capable of supporting complementary kinetic decorative mobiles that extend from the substrate. A track member extends across the substrate to form a continuous path. Toy vehicles can be mounted for translating across the track member and operative interacting with the kinetic mobiles to cause a kinetic movement. The operator can be provided with hand controls for driving the toy vehicles to race across the track set.

21 Claims, 7 Drawing Sheets

FIG. 6
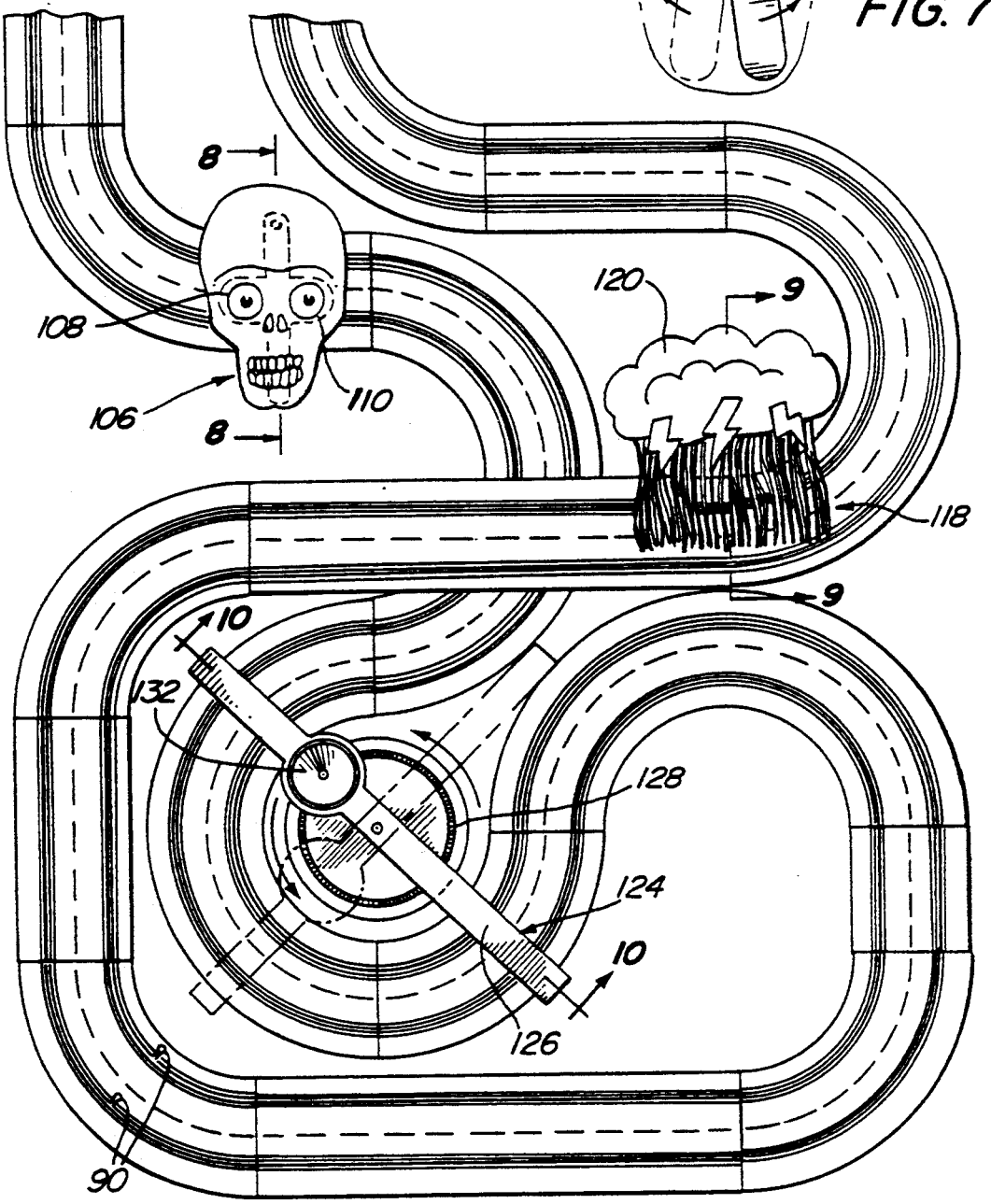
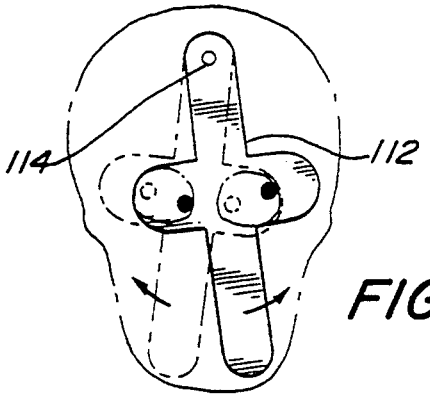
FIG. 7

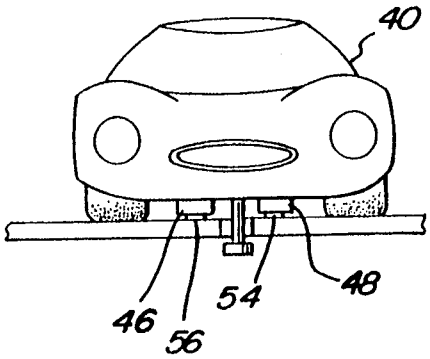
FIG. 15
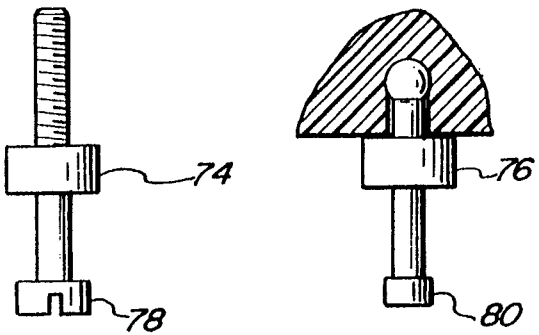
FIG. 18
FIG. 17
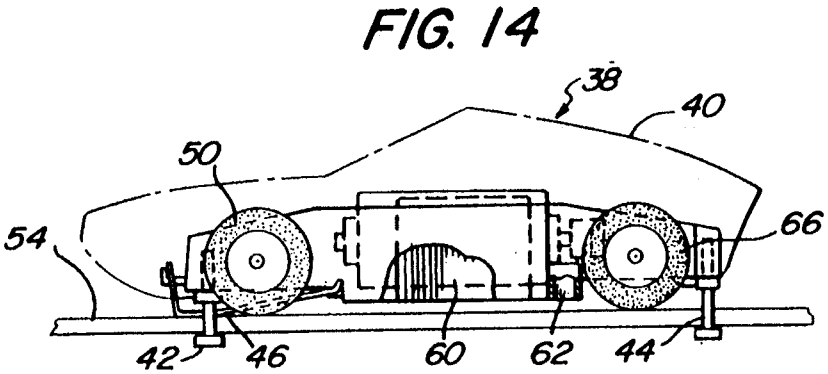
FIG. 14
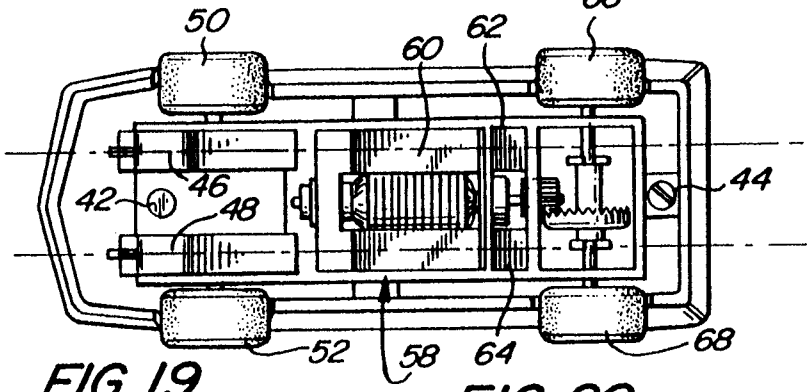
FIG. 16
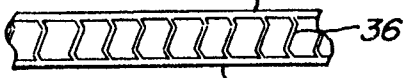
FIG. 20
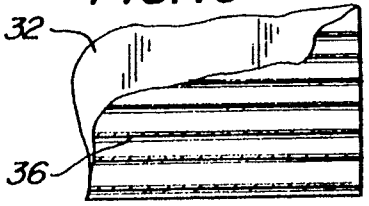
FIG. 19

WALL MOUNTED SLOT CAR TRACK WITH MOVING ACCESSORIES

BACKGROUND OF THE INVENTION

1. Field of the Invention

The present invention relates to a decorative kinetic poster display in combination with a vertical road racing game which animates kinetic mobile features of the poster display during the operation of toy vehicles.

2. Description of Related Art

Various forms of posters have become popular decorative items in children's and teenager's rooms. Frequently these posters have a particular fad theme or relate to a movie actor, rock star, sports star, or popular toy figure. Usually the poster assumes a static configuration and simulates a traditional wall picture hanging as far as its decorative purpose on a vertical wall or door of the occupant's room. The poster does not provide any additional play feature, and usually remains only a passive decorative item in the furnishing of the room.

Children have frequently played with numerous forms of toy vehicle sets, including train sets and toy vehicle racing games. Usually a series of track segments are provided which can be subjectively put together by the child on the floor of his room or on a separate support member. The rails on the tracks are energized by a transformer and toy vehicles are mounted on the rails and guided by a single pin and slot arrangement. Individual hand controllers are frequently utilized to race the toy vehicles as a toy racing vehicle set. The racing set is usually dismantled or stored after use, since it can occupy a substantial portion of the horizontal surface of the room. Accordingly, a barrier to the enjoyment of a toy racing set has been the necessity to set up the tracks and reassemble the racing set when it is desired to be used.

An example of a toy vehicle racing game can be seen in U.S. Pat. No. 4,386,777, wherein toy vehicles are magnetically coupled by the armature of the electric motor to varying thicknesses of metal rails to enable the vehicles to race from a horizontal surface across a vertical loop that extends up the side of a wall.

A slotted track racing system is disclosed in U.S. Pat. No. 4,795,154, with the toy vehicles being held on a track by a guide beam.

Other examples of slotted racing car apparatus can be seen in the following patents: U.S. Pat. Nos. 2,631,853, 3,367,657, 3,510,223, 3,411,783, 4,066,211, 4,163,555, 4,697,812, 4,728,104, and 4,997,187.

The German Auslegeschrift No. 1,137,663 discloses a toy train having guide pins that can be moved on a rail, while Italian Patent No. 512,304 discloses a toy vehicle racing system.

The provision of a kinetic poster in combination with a vertical road racing set, in the manner as set forth hereinafter, has not been taught in this field.

SUMMARY OF THE INVENTION

The present invention provides a decorative wall poster having kinetic mobiles which can interact with a vertical vehicle toy set to provide a colorful play action wall hanging toy for a child's room. A lightweight substrate having a planar surface configuration can support decorative designs which can further include one or more kinetic decorative mobiles suspended out from the substrate surface. The substrate can comprise a light-weight composite plastic structure which permanently mounts a continuous track set. The substrate is fastened to hang vertically from a wall surface so that it does not detract from usage of the floor space of the room. The track set extends across the substrate and adjacent or through the kinetic decorative mobiles so that when a vehicle is driven across the track set, it will interact with the mobiles and cause kinetic movement of the mobiles. For example, a simulated human skull mobile with movable eyes can be positioned adjacent the track set so that a vehicle will strike a support member connected to the eyes of the skull and cause the eyes to reciprocate as if it is glancing about the room. The vertical alignment of the substrate will permit gravity to reposition the eyes to their desired static position. Other kinetic mobiles such as rotatable noise generators, reflective strips, rotatable indicators, etc. can be used.

Preferably, the vertical road racing feature of the decorative wall panel will include a pair of rails on the track set to enable a child to race against another vehicle or to race against another child controlling the other vehicle. A transformer can be directly connected to an AC output, and hand controllers can be connected to the individual rails and the transformer, to permit each child to control the operation of a vehicle. The hand controllers can be advantageously hung from an edge of the substrate when not in use. Each of the rail pairs includes a central elongated slotted opening with retention flanges forming the perimeters of the opening. Each of the toy vehicles includes at least one retainer member suspended from the chassis so that it can interlock with the elongated opening in the track to maintain the toy vehicle operative in a vertical plane. Preferably, a pair of retainer members at, respectively, the front and rear of the toy vehicle are used. The rear retainer member may or may not interlock with the slotted opening, depending on the skill level of the operator. The relative dimensions of the retention members and the placement of magnetic traction members on the chassis ensures that power contact pads will be maintained in contact with power rails to enable movement of the toy vehicle relative to the vertical surface. The retention members ensure that the vehicle remains within the magnetic field of the magnetic traction members. These components keep the toy vehicle close enough to the vertical substrate so that the rear wheels connected to the electric motor will not slip to a degree that renders the vehicle inoperative, regardless of the toy vehicle's position on the vertical track set.

The rear retention members are further replaceable to adjust the skill level required of the player. Thus, a retention member that will release from the slotted opening will allow a spinout on a curve that would render the vehicle inoperative.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 6 is a plan view of a track set of various kinetic mobiles;

FIG. 7 is a view of a pivotable component part of a skull mobile;

FIG. 14 is a partial elevated side view of a toy vehicle and track set;

FIG. 15 is a front elevated view of a track set and toy vehicle;

FIG. 16 is a bottom plan view of a toy vehicle;

FIG. 17 is an elevated view of a retention member;

FIG. 18 is an elevated view of an alternative retention member;

FIG. 19 is a partial cross-sectional view of the poster substrate;

FIG. 20 is a side view of the poster substrate; and

DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a kinetic poster display and vertical road racing set.

Figure 1:
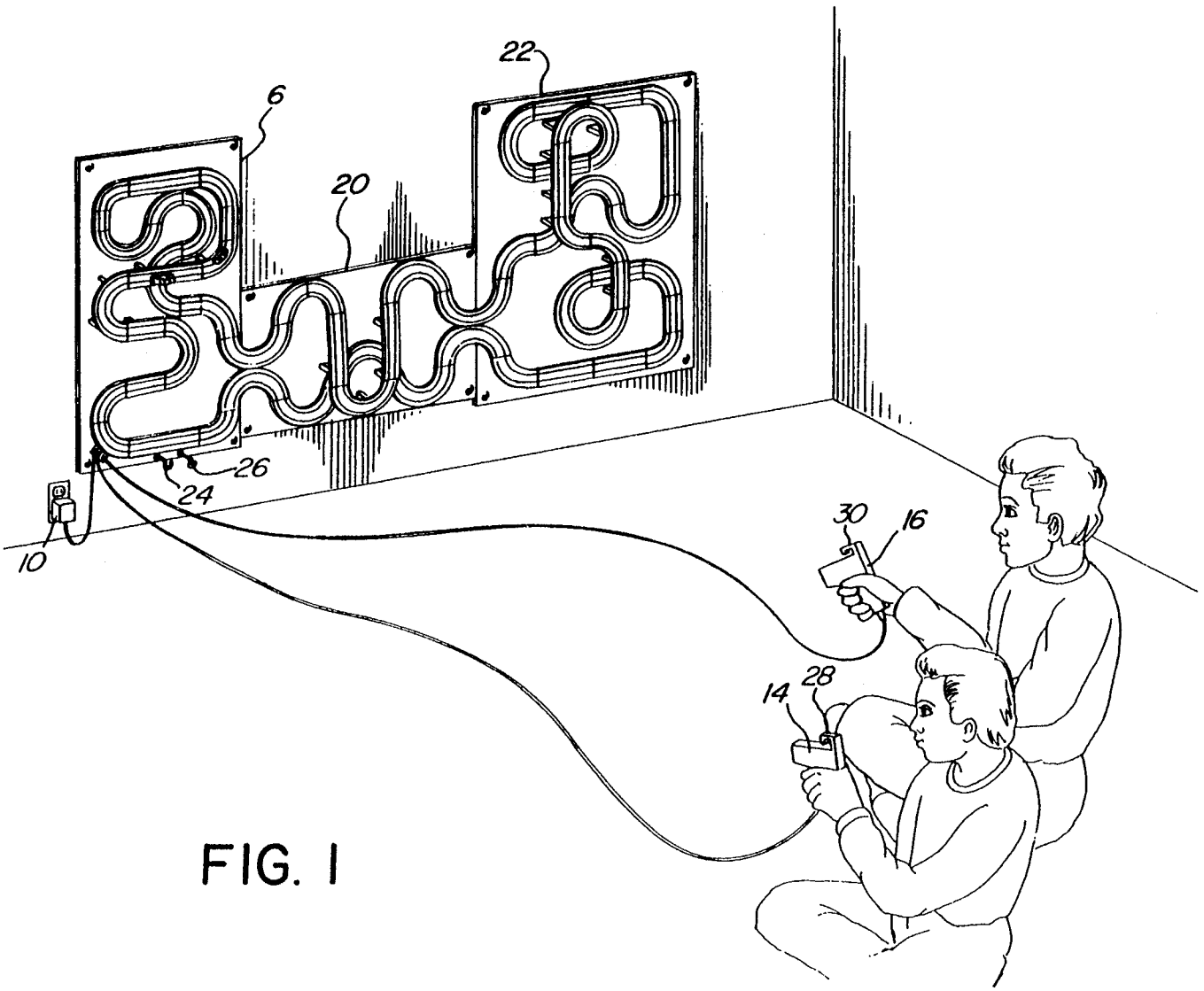
FIG. 1 is a perspective view of a series of kinetic poster substrates and road racing game track sets connected together for operation on the wall of a room.
Figures 2, 21:
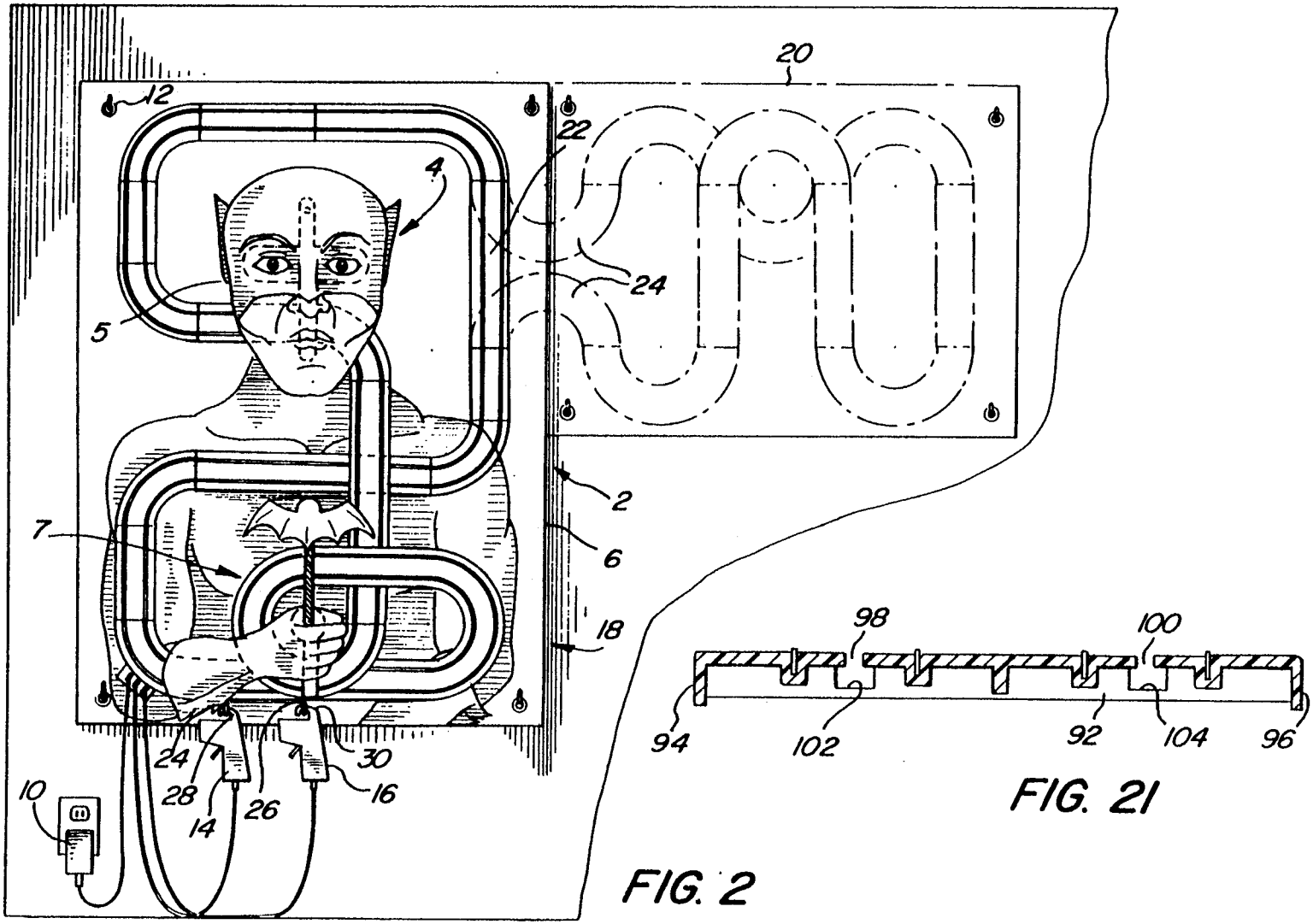
FIG. 2 is a plan view of one embodiment of a kinetic poster display of the present invention.
FIG. 21 is a cross-sectional view of an alternative track set.
Figure 4:
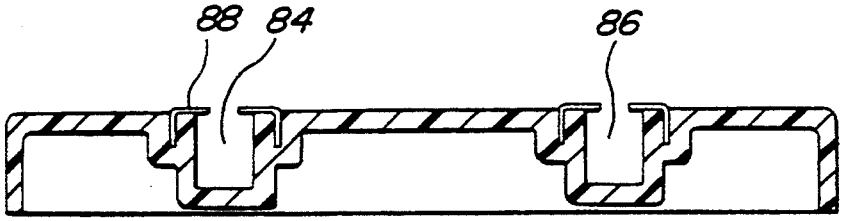
FIG. 4 is a cross-sectional view of an alternative embodiment of a track segment.

Referring to FIG. 2, a kinetic poster and vertical road racing set 2 is disclosed. As can be seen, a colorful poster of an action figure 4 is disclosed which can be printed on a substrate 6. Mounted on the substrate 6 is a continuous loop track set 8 which can accommodate the racing of a pair of toy simulated racing vehicles. A transformer 10 can be directly plugged into an electric A.C. wall outlet so that it is suspended vertically on a wall. A series of eyelets 12 are embedded at the corners of the substrate 6 and can accommodate various forms of known hangers or fasteners for affixing the substrate to a vertical wall. A pair of hand controllers 14 and 16 are used to control the speed of the vehicles, and basically comprise a trigger-operated variable resistor that is appropriately connected to the power rail of each of the pair of rails. The other rail in each rail set can be connected to a common ground. A kinetic mobile 18 can be activated by a vehicle as it translates across its respective rail set. As a feature of the present invention, a supplemental substrate 20 can be operatively linked to the base substrate 6. This is accomplished by removing a segment of a straight track portion 22 and interconnecting it with transitional curved track segments 24, as will be described later. As shown, for example, in FIG. 1, a third supplemental substrate 22 can be likewise attached to expand both the graphics that can cover the wall and the play action features of the road racing set.

As can be seen in FIG. 2, the hand controllers 14 and 16 are advantageously hung from hooks 24 and 26 that are positioned at the bottom of the substrate 6. The respective hand controllers 14 and 16 each carry corresponding hook members 28 and 30 that can be integrally molded into the body of the controllers to facilitate the hanging of the hand controllers from the hook members 24 and 26. As a result, in a storage mode the controllers are conveniently hung from the wall, and the entire set can be conveniently stored without impinging upon the floor space of the room.

Figure 8:
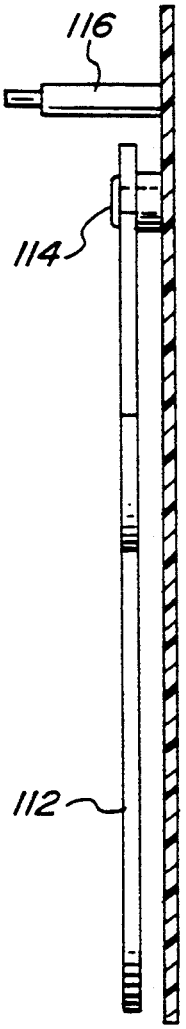
FIG. 8 is a cross-sectional view of a skull mobile.
Figure 9:
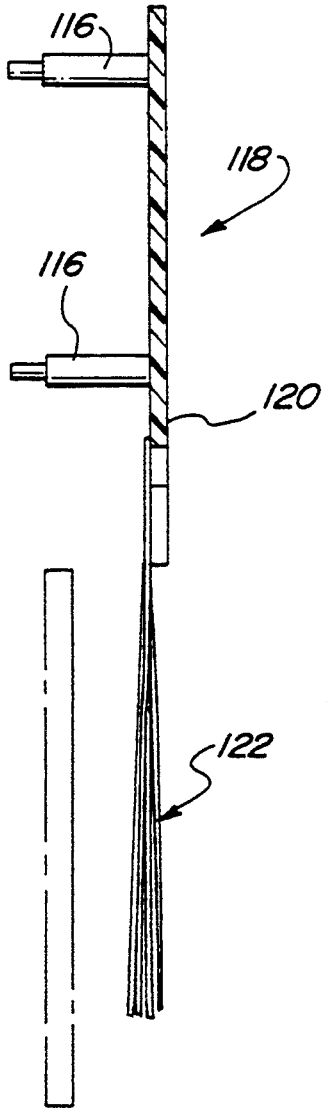
FIG. 9 is a cross-sectional view of a rain cloud mobile.

As will be explained in greater detail with regard to FIGS. 7 and 8, a movable eye kinetic mobile 5 can be activated by racing cars to cause the action of FIG. 4 to appear lifelike as its eyes scan the room. Depending on the size of the surface head plate, the pivoting plate supporting the eyes can rotate under or beyond the surface head plate.

Another kinetic mobile 7 can simulate a baton held in the action figure's hand which will rotate when contacted by the toy vehicles.

As can be appreciated, it is highly desirable for each of the substrates to be relatively lightweight so that the poster set 2 can be conveniently hung vertically on the child's wall. Referring to FIGS. 19 and 20, partial segments of the substrate 6 are disclosed. Basically, the substrate 6 comprises an upper planar surface 32 and a lower planar surface 34. A series of curved spacer members 36 integrally support the upper and lower planar surfaces. Each of the spacer members 36 extend in parallel fashion to leave porous channels that extend from one side to the other side of the substrate. FIG. 18 discloses a partially removed upper planar surface showing the spacer members 36. The substrates can be formed from a plastic material which is integrally linked together to provide a sturdy, but lightweight substrate. The respective planar surfaces can easily receive printed indicia to form any subjectively-desired poster configuration.

Referring to FIGS. 14, 15, and 16, an example of a toy vehicle 38 for vertical racing is disclosed. A subjectively-determined housing or body configuration 40 is mounted on a chassis that also supports a front retention member 42 and a rear retention member 44. Spring-biased power contact members 46 and 48 are mounted between the front wheels 50 and 52. Because the racing surface is a vertical surface, the front wheels are primarily a decorative feature, and the contact members 46 and 48 are provided to slide upon metal rails 54 and 56. An electric motor 58 includes magnetic field pieces 60 that are purposely positioned to be adjacent the surface of the respective rails 54 and 56. An additional pair of magnetic traction members 62 and 64 are also aligned on the chassis to provide an additional magnetic attraction to the respective rails 54 and 56. The combined magnetic force is sufficient to hold the rear wheels against the track set 8. The electric motor 58 drives a shaft with a pinion gear that, in turn, drives a gear connected to the rear axle for driving the rear wheels 66 and 68.

Figure 5A:
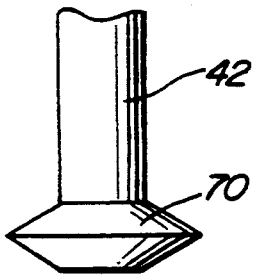
FIG. 5*a* is a partial view of a retention member.
Figure 5B:
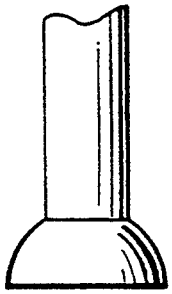
FIG. 5*b* is a partial view of an alternative embodiment of a retention member.
Figure 5C:
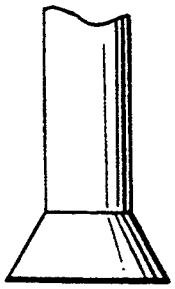
FIG. 5*c* is a further alternative view of a retention member.

Various configurations of retention members are shown in FIGS. 5*a*, 5*b*, and 5*c*. In essence, the head portion 70 is large enough to be captured by flanges 72, shown in FIG. 3, which form the respective perimeters of an elongated slot opening in the track set 8. Preferably, there is a clearance of approximately 0.005-inch to 0.025-inch between the retention head 70 and the underside of the flanges 72.

For toy vehicles of an HO scale size, it is believed that a clearance range between the retention head 70 and the underside of the slot flanges 72 should optimally be 0.015-inch to 0.020-inch. In addition, it is believed that the optimum location for the magnetic field pieces 60 is centrally located between the wheel base and directly over the rails. The optimum position for the traction magnets 62 and 64 is as close to the driving wheels as possible, and also centrally located over the pickup rails. The position of the front retention member 42 is in the middle of the vehicle and at the contact point of the electrical pickups.

The rear retention member 44 can likewise have a retention head 70, which also is designed to be positioned within the slot opening of the track set 8. As shown in FIG. 16, the rear retention member 44 has a slotted head to receive a screwdriver so that it can be replaced with an alternative retention member, depending upon the skill level of the operator. The relative clearance between the retention head 70 and the underside of the flanges 72 is sufficient to hold the contact shoes 46 and 48 in operative contact with the respective rails 54 and 56 without causing a binding or excessive friction with the track set 8. Additionally, this clearance range ensures that the magnetic attraction of both the motor field pieces 60 and the respective magnetic traction members 62 and 64 can effectively magnetically couple with the rails 56 and 54 to provide adequate traction for the rear wheels 66 and 68. This feature is important because of the vertical alignment of the poster substrate 6, and traction is important to ensure an ability to stop the toy vehicle in a vertical alignment and then start it again for play action by the operator. It would be possible to even position the substrate in an upside down arrangement, e.g., on the ceiling, and the combination of the retention members and magnetic field would still enable an operative road racing system.

As can be seen in FIGS. 17 and 18, alternative rear retention members 74 and 76 can be provided. The retention head 78 has a width that can escape from the slotted opening between the track flanges 72. Likewise, the retention member 76 has a retention head 80 that is only slightly larger than the shaft of the retention member. The purpose of these alternative rear retention members is to enable the skill level in the operation of the road racing set to be varied. Thus, with the retention members 74 and 76, the rear of the vehicle can disengage at different speeds and turns on the track set 8. When the rear of the vehicle is disengaged, the orientation of the vehicle can then pivot about the front retention member 82, and the electrical contact of the shoes 46 and 48 and/or the traction of the rear wheels 66 and 68 will render the vehicle inoperative. Thus, a player of a higher skill level can use, for example, the retention member 80. If he does not closely control the speed of the vehicle as it approaches various turns on the track set 8, his vehicle will spin out of control and his opponent can then beat him. These variable-sized retention pins add an additional skill level to the operation of the road racing set. In a production version of the retention members, it is contemplated to use a snap-fit to the chassis of the toy vehicle as shown in FIG. 18.

Figure 3:
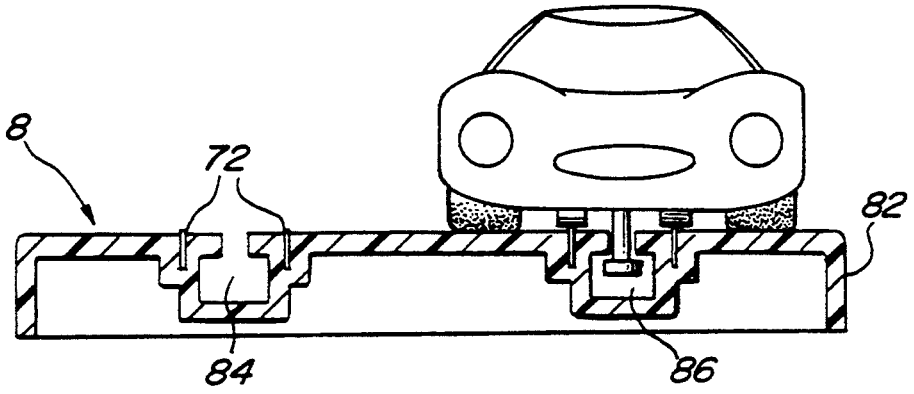
FIG. 3 is a cross-sectional view of a track segment of the present invention.

Referring to FIG. 3, a cross-sectional view of one possible embodiment of the track set 8 is disclosed. Support flanges 82 can contact the substrate 6, and the individual track segments can be permanently attached to the substrate 6 by fasteners (not shown). A pair of elongated slots 84 and 86 are centrally located between the respective pickup rails to thereby provide parallel paths for a pair of vehicles. As can be seen, the flanges 72 can capture the retention members that are suspended from the bottom of the vehicle.

An alternative embodiment of a segment of the track set 8 can be seen in cross-sectional view in FIG. 4. In this embodiment, the elongated slots or openings 84 and 86 are closed not by flanges, but rather by the pickup rails 88. As can be seen, the pickup rails are bent to define an L-shaped configuration, with the underside of the pickup rails 88 performing the function of the flanges 72 in interfacing with the retention members.

As seen on FIG. 6, the track set 8 can include notched open configurations 90 positioned on the inside radius of a curved track for communicating with the slot that enables the retention heads of the retention members to be inserted within the track set and to interface with the elongated slot opening. This particular position ensures that the centrifugal force of the curved track will prevent contact of the retention members with notched entrance openings. Basically, the front or rear retention members are inserted within the notched configuration 90, and then the vehicle is manipulated to align the remaining retention member for mounting it within the elongated slot opening. As can be appreciated, when utilizing retention members 74 and 76 having very small retention heads 78 and 80, these retention members can be directly inserted within the elongated opening, since they are designed to be released under certain driving conditions.

Referring to FIG. 21, an alternative embodiment of a track section is shown in cross-sectional configuration which can be used in the track set 8. In this embodiment, a series of spaced cross-beams 92 supply support for the track surface and the outer flanges 94 and 96. The track surface has elongated slots 98 and 100 positioned between the pickup rails. The underside of the surface of the track serves the direct function of the flanges. In essence, there is no bottom to the cavity of the slot, as shown in the embodiments in FIGS. 3 and 4. The cross-beam 92, however, is appropriately notched to provide openings 102 and 104 to accommodate the passing of the retention head as the vehicle crosses a support cross-beam 92.

As shown in FIG. 2, a straight track segment 22 can be replaced by a transition track segment 24 to enable supplementary poster substrates to be added to enlarge the display and vehicle raceway. As mentioned previously, one of each set of power rails is connected to a DC voltage source supplied by the transformer 10, while the other rail serves as a common ground. When interconnecting a supplementary substrate, it is important that the power rail and the common ground are appropriately matched. If the track on one of the substrates loops over itself to, in effect, form a FIG. 8, an outside rail member becomes, in effect, an inside rail member on one-half of the looping portion of the FIG. 8. When making an electrical connection, it is important that the integrity of the power rail and the common ground be appropriately matched so that the vehicles can be driven across any combination of sets.

Referring to FIG. 6, a kinetic mobile 106 in the form of a human skull extends across a segment of the entire track set. Apertures 108 and 110 extend through the face of the skull, which is basically a flat plate, for example, formed of the same type of material as the substrate. A striker member 112 is pivotally mounted through a pivot pin 114 to the substrate 6. The striker member 112 can carry indicia indicating bloodshot eyes of the skull figure. The mobile skull member 106 will have its eyes staring forward when the striker member 112 is at rest and subject to a gravity pull in the vertical plane. When either one of the vehicles passes underneath the upper surface of the mobile skull 106, it will strike the striker member 112 and displace the eyes so that they will rock back and forth as if the skull is scanning from one side to the other. A cross-section of the skull is shown in FIG. 8 with a mounting pin 116 being used to attach the mobile skull 106 across the track set.

A simulated rainstorm is disclosed as a mobile rain cloud member 118. The upper portion or decorative plate 120 simulates the configuration and texture of a cloud, while a series of thin strips of metalized plastic 122 hang down as simulated rain strips across the track set 8. The respective mounting pins 116 are positioned to permit the vehicles to contact the rain strips 122 and create movement each time the vehicles translate across the mobile rain cloud 118.

Figure 10:
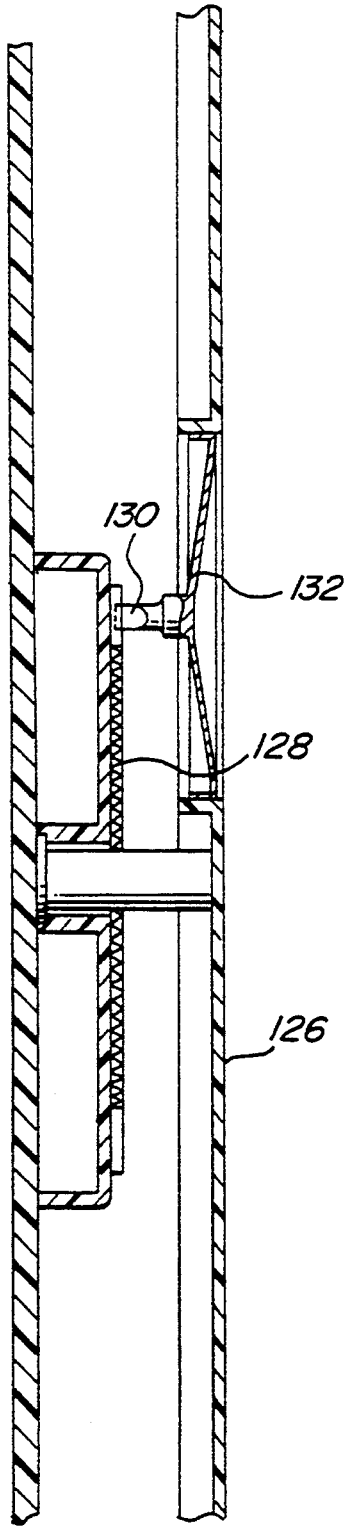
FIG. 10 is a cross-sectional view of a noise generator mobile.

An example of a noise-generating mobile 124 is disclosed in FIG. 6 and in cross-section in FIG. 10. In this mobile, an elongated striker member 126 is pivotally mounted to the substrate 6 in a position adjacent a location wherein the track makes a 330-degree turn. Any vehicle traveling on the track will contact one side of the striker member 126 and will drive the striker member 126 to rotate. A series of indentations or grooves 128 are mounted in a ring configuration beneath the striker member 126, and are positioned to interface with a stylus 130 that is suspended from a flexible plastic diaphragm speaker 132. The striker member 126 forms the frame of the diaphragm speaker 132 and causes the speaker 132 and the stylus 130 to also rotate and contact the series of grooves. This contact will produce a grating or ratcheting noise as the vehicles travel about this curve. As can be appreciated, the stylus could also interface with other noise-generating indentations to provide alternative sounds.

Figure 11:
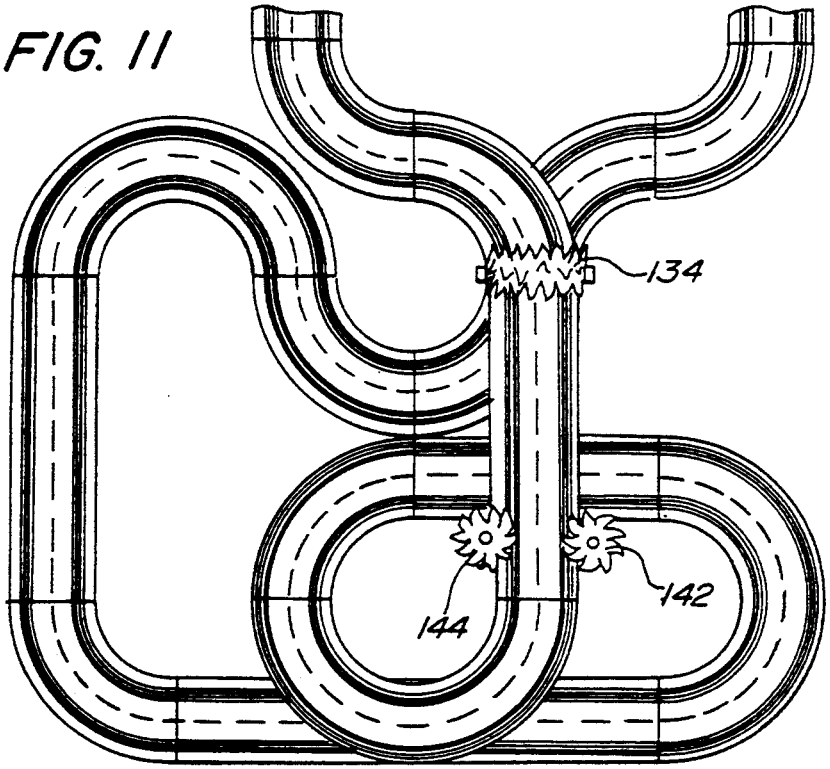
FIG. 11 is a plan view of alternative kinetic mobiles.
Figure 12:
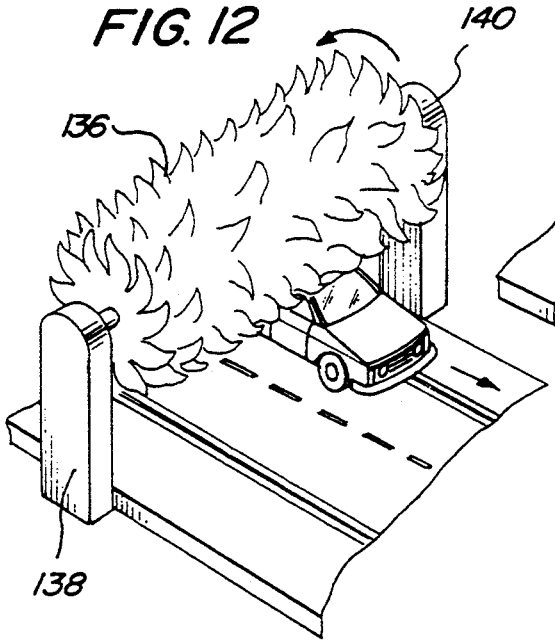
FIG. 12 is a perspective view of a mobile.
Figure 13:
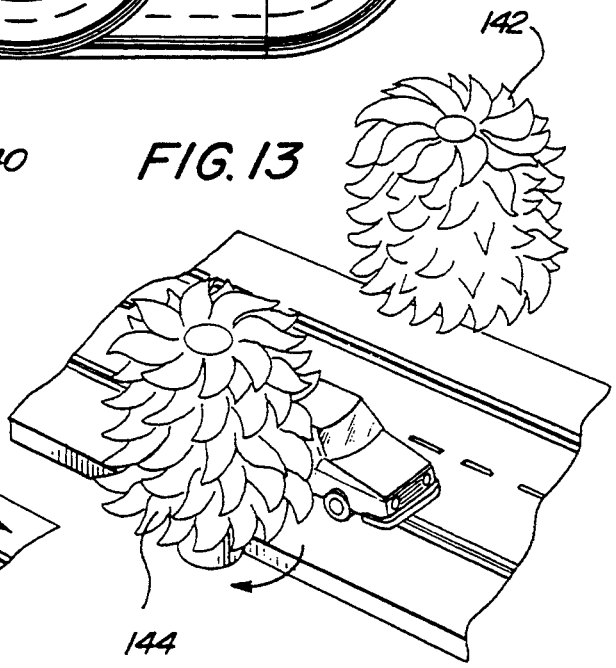
FIG. 13 is a perspective view of a mobile.

Referring to FIG. 11, the revolving flame kinetic mobile 134 extends across a track segment and can be contacted by either of the toy vehicles that are raced on the track set. The simulated flames 136 are preferably formed of a high impact styrene core as a bearing with an integral outer soft foam covering of a subjective design, as shown in FIG. 12, and is pivotally mounted on a pair of support posts 138 and 140. Contact with a toy vehicle will cause the mobile 134 to rotate. Likewise, a pair of cantilevered rotatable flame mobiles 142 and 144 can be individually contacted on the side of each toy vehicle, as shown in FIG. 13. A soft, flexible sponge-like material can be configured and appropriately colored to simulate flames.

As can be appreciated, the provision of the kinetic mobiles on the poster substrate can be further designed to complement the particular decorative indicia that has been printed on that substrate. The kinetic mobiles that have been described herein are only illustrative of the potential for providing kinetic mobiles that can be driven by the vertically-raced toy vehicles. These animated features, along with an appropriate poster indicia, provide a wide choice of options for artists in designing decorative kinetic posters. While the present invention has been disclosed primarily with a toy vehicle racing set, it should be readily appreciated that other vehicles, such as trains, motorcycles, etc. can be simulated to comprise the racing set.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. A combination decorative wall poster and vertical vehicle toy set, comprising:

a wall having a vertical surface;

a substrate having colorful indicia for providing decorative designs for a child's room on a front surface and having a substantially planar rear surface;

means for hanging the substrate vertically on the wall as a decorative wall poster with the rear surface of the substrate being parallel to the vertical surface of the wall;

a kinetic decorative mobile extending from the substrate and having at least one movable means that is aligned for movement in a plane, substantially parallel to the wall;

at least one track member extending across the front surface of the substrate to form a continuous path, the continuous path extending beneath the movable means position, the track member includes two pairs of rails extending across the front the substrate adjacent the mobile, each pair of rails having an elongated opening with retention flanges positioned between the rails;

a pair of toy vehicles, mounted for translating across the track member, the track member being arranged on the substrate to permit the toy vehicles to contact the mobile as it travels along the track member to cause a kinetic movement of the movable means, a first toy vehicle is mounted on one set of rails, and a second toy vehicle is mounted on the other set of rails, each toy vehicle including a non-articulated chassis and a first retainer member that interlocks with the retention elongated opening to maintain the toy vehicle operative in a vertical plane, wherein each toy vehicle can contact the mobile to cause a kinetic movement of the movable means;

a second retainer member is mounted on the chassis displaced from the first retainer member and extending into the elongated opening; and means for driving the toy vehicles along the track member, including, on each toy vehicle, drive wheels and electrical motor with magnetic field pieces forming a magnetic attraction with its set of rails, the interlocking of the first retainer member and the retention flanges permit sufficient clearances to enable the drive wheels to drive the toy vehicle across the substrate without interference while prohibiting the magnetic field pieces from losing their magnetic attraction whereby adequate traction of the drive wheels is maintained with the substrate in both a static and translating mode of operation during a vertical alignment of the toy vehicle on the substrate.

2. The invention of claim 1, wherein the indicia is an action figure and the kinetic decorative mobile simulates a head of the action figure.

3. The invention of claim 1, wherein the indicia is an action figure and the kinetic decorative mobile simulates the hands of the action figure.

4. The invention of claim 1 wherein the means for driving the toy vehicle includes a hand-size controller and further support means are provided on the substrate to hang the controller from the substrate.

5. The invention of claim 1, wherein the second retainer member has a shaft that is removably connected to the toy vehicle at one end, and the other end of the shaft is configured to be captured by the elongated opening.

6. The invention of claim 1, further including a second substrate member having at least a second track set, means for mounting the second substrate member in a vertical plane, and means for interconnecting the first track set with the second track set to increase the respective track length available for each toy vehicle.

7. The invention of claim 1, wherein the magnetic means includes a pair of magnetic traction members mounted on each toy vehicle to provide a magnetic force field linking with the pair of rails to assist in adhering the toy vehicle to the vertical substrate.

8. The invention of claim 1, wherein the driving members further include an electrical motor with a magnetic field pieces in each toy vehicle, and the magnetic field pieces are positioned adjacent the magnetic traction members and close enough to the rails to magnetically link and assist in adhering the vehicle to the vertical substrate.

9. The invention of claim 1, wherein the driving means includes a transformer and hand controllers connected to the transformer and the rails and means for vertically mounting the hand controllers to the substrate.

10. The invention of claim 1 wherein the substrate member includes parallel porous channels to provide a sturdy lightweight configuration.

11. The invention of claim 1 wherein the means for driving the toy vehicle includes a controller having means for hanging the controller from the substrate, including a hook member on the controller.

12. The invention of claim 1 further including a plurality of removable retainer members having retention tracks of different widths.

13. The invention of claim 1 wherein the front surface of the substrate is connected to the rear surface by a series of parallel spacer members.

14. The invention of claim 13 wherein the parallel spacer members are curved.

15. An improved road racing set that is operable on a vertical wall or ceiling of a room, comprising:

a track set forming a closed continuous path, the track set including means for mounting on a wall or ceiling;

a toy vehicle including a body member with a front and a rear portion and a lower surface, and a set of wheels rotatably connected to the body member;

an electrical motor mounted on the toy vehicle body member to drive the set of wheels, including a magnetic field piece positioned adjacent the lower surface of the body member;

a magnetic traction member mounted between the magnetic field piece and the driven wheel set adjacent the lower surface of the body member; and a first retention member having a shaft extending from the front lower surface having a retention head at its furthest end, the retention head extending further from the lower surface than the driven wheel set; the track set including a slotted elongated opening extending along the continuous path with a pair of flanges defining the perimeter of the slotted opening, and a pair of metal rails capable of magnetically coupling with the magnetic field piece and the magnetic traction member surrounding the slotted elongated opening, the retention head being wider than the slotted opening and being capable of interfacing with the pair of flanges to prevent the toy vehicle from releasing from the track set, the metal rails being spaced apart a sufficient distance to be aligned with the magnetic field piece and the magnetic traction member, the strength of the combined magnetic field of the magnetic field piece and the magnetic traction members being sufficient to operatively adhere the toy vehicle to the track set, when in a vertical or upside down arrangement, by magnetically coupling with the metal rails, wherein the track set includes a curved track segment with a notched opening extending from the slotted elongated opening towards the inside of the curve and having a width sufficient to insert the retention member head.

16. The invention of claim 15, further including a second retention member having a shaft extending from the rear lower surface to extend into the slotted elongated opening.

17. The invention of claim 15, further including a kinetic decorative mobile extending across the track set and movable upon contact with the toy vehicle translating along the track set.

18. The invention of claim 17, wherein the kinetic decorative mobile simulates a humanoid head configuration and a movable member simulates eyes that can be moved by contact with the toy vehicle.

19. The invention of claim 17, wherein the kinetic decorative mobile simulates a rain cloud and includes flexible strips hanging across the track set for contact with the toy vehicle.

20. The invention of claim 17, wherein the kinetic decorative mobile is a movable member that is pivotally attached adjacent the track member and includes a combination speaker and stylus and means for activating the stylus to produce sound when the speaker is operatively positioned adjacent the movable member.

21. An improved road racing set that is operable on a vertical wall or ceiling of a room, comprising:

a track set forming a closed continuous path, the track set including means for mounting on a wall or ceiling;

a toy vehicle including a body member with a front and a rear portion and a lower surface, and a set of wheels rotatably connected to the body member;

an electrical motor mounted on the toy vehicle body member to drive the set of wheels, including a magnetic field piece positioned adjacent the lower surface of the body member;

a magnetic traction member mounted between the magnetic field piece and the driven wheel set adjacent the lower surface of the body member;

a kinetic decorative mobile extending across the track set and movable upon contact with the toy vehicle translating along the track set; and a first retention member having a shaft extending from the front lower surface having a retention head at its furthest end, the retention head extending further from the lower surface than the driven wheel set; the track set including a slotted elongated opening extending along the continuous path with a pair of flanges defining the perimeter of the slotted opening, and a pair of metal rails capable of magnetically coupling with the magnetic field piece and the magnetic traction member surrounding the slotted elongated opening, the retention head being wider than the slotted opening and being capable of interfacing with the pair of flanges to prevent the toy vehicle from releasing from the track set, the metal rails being spaced apart a sufficient distance to be aligned with the magnetic field piece and the magnetic traction member, the strength of the combined magnetic field of the magnetic field piece and the magnetic traction members being sufficient to operatively adhere the toy vehicle to the track set, when in a vertical or upside down arrangement, by magnetically coupling with the metal rails, wherein the kinetic decorative mobile is a movable member that is pivotally attached adjacent the track member and includes a combination speaker and stylus and means for activating the stylus to produce sound when the speaker is operatively positioned adjacent the movable member.

* * * * *